US009592886B2

(12) United States Patent
Frabetti

(10) Patent No.: US 9,592,886 B2
(45) Date of Patent: Mar. 14, 2017

(54) BOAT WITH MOBILE RETRACTABLE RIGID CANOPY

(71) Applicant: FERRETTI S.P.A., Cattolica (Rimini) (IT)

(72) Inventor: Andrea Frabetti, Zola Predosa (IT)

(73) Assignee: FERRETTI S.P.A., Cattolica (Rimini) (IT)

( * ) Notice: Subject to any disclaimer, the term of this patent is extended or adjusted under 35 U.S.C. 154(b) by 0 days.

(21) Appl. No.: 14/785,427

(22) PCT Filed: Apr. 15, 2014

(86) PCT No.: PCT/IB2014/060728

§ 371 (c)(1),
(2) Date: Oct. 19, 2015

(87) PCT Pub. No.: WO2014/174406

PCT Pub. Date: Oct. 30, 2014

(65) Prior Publication Data

US 2016/0052603 A1 Feb. 25, 2016

(30) Foreign Application Priority Data

Apr. 23, 2013 (IT) ..... MI2013A0669

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
(Continued)

(56) References Cited

U.S. PATENT DOCUMENTS 3,370,308 A 2/1968 Krenzler
5,044,298 A * 9/1991 Pepper ..... B63B 17/02 114/361

(Continued)

FOREIGN PATENT DOCUMENTS

CN 1293122 A 5/2001
CN 202243959 U 5/2012

(Continued)

OTHER PUBLICATIONS

International Search Report and Written Opinion mailed Jul. 9, 2014 for PCT/IB2014/060728 to Ferretti S.P.A. filed Apr. 15, 2014.

(Continued)

*Primary Examiner* — Lars A Olson
(74) *Attorney, Agent, or Firm* — Vorys, Sater, Seymour and Pease LLP

(57) ABSTRACT

A boat includes a hull, a deck and a living area, the latter delimited at the front by a windscreen and having a fixed structure, extending from that area, supporting boat functional members such as antennas and the like, there being a one-piece mobile rigid canopy, moved by moving members and adapted to take at least a first working position in which it is arranged above the living area and at least a second working position in which it is separated from the latter and is associated to the deck in front of the windscreen, the rigid canopy resting on and being constrained to the windscreen and to the fixed structure when it is in its first working position. The moving members are articulated structures placed laterally to the deck.

16 Claims, 15 Drawing Sheets

(58) Field of Classification Search
USPC ..... 114/361
See application file for complete search history.

(56) References Cited

U.S. PATENT DOCUMENTS

| | | | | |
|---|---|---|---|---|
| 6,390,532 | B1 | 5/2002 | MacFarland | |
| 8,770,135 | B2 * | 7/2014 | Craze | B63B 17/02 114/361 |
| 2002/0030381 | A1 | 3/2002 | Schutt et al. | |
| 2010/0083890 | A1 | 4/2010 | Johnson | |
| 2011/0303142 | A1 | 12/2011 | Craze et al. | |

FOREIGN PATENT DOCUMENTS

| | | | |
|---|---|---|---|
| FR | 2946953 | A1 | 12/2010 |
| WO | 2010083551 | A1 | 7/2010 |

OTHER PUBLICATIONS

Office Action of Nov. 2, 2016 from Chinese Patent Application No. 201480022979.0 to Ferretti S.P.A.
Search Report of Oct. 24, 2016 from Chinese Patent Application No. 201480022979.0 to Ferretti S.P.A.

* cited by examiner 8
23
65
66
16
60
62
67
68
32
11
7
65
66
23
32
67
11
7
67
16
3
18
23
22
22
2
5
31
23
A
32
11
7
4
1

BOAT WITH MOBILE RETRACTABLE RIGID CANOPY

CROSS-REFERENCE TO RELATED APPLICATIONS

This is a §371 National Stage Application of International Application No. PCT/IB2014/060728 filed on Apr. 15, 2014, claiming the priority of Italian Patent Application No. MI2013A000669 filed on Apr. 23, 2013.

The object of the present invention is a boat according to the preamble of the main claim.

In order to offer a particular comfort to passengers, it is known to provide a covering element or canopy to a living area of the deck which also includes a control zone of the boat, such as a motorboat. The canopy can be rigid or folding.

With particular reference to rigid canopies, solutions are known that allow the movement of a corresponding canopy above the living area of the boat. Such a canopy can reach this working position ("first working position") starting from a zone of the boat (front or rear to the living area) in which it is stored when the use thereof is not required (or when it is in a "second working position" or rest position). Such a movement can be achieved with many systems and devices: for example, through articulated structures connected on one side to the hull or deck of the boat and on the other side to the sides of the canopy, or through devices that pull or push the canopy along fixed rails associated to the deck.

The canopy can also be associated to a rigid structure provided, for its support, at the living area, said canopy being able to move by sliding and rotating around parts of such a structure in order to achieve a working position, above such a zone (first working position) or on a side of the latter (second working position).

Furthermore, especially in the case of a solution such as that described above, the canopy may comprise one or more relatively mobile parts in order to allow, above all, easy positioning of the canopy in its second working position or rest position.

Known boats with mobile rigid canopy however, and frequently, provide support structures for the canopy specifically intended for this purpose. The presence of such structures, however, negatively affects the aesthetics of the boat. Known solutions, moreover, frequently provide for the roof, in its second working position, to remain in a visible position on the boat, which still adversely affects the aesthetics of the boat.

In addition, the known embodiments of boats with mobile rigid canopy have complex moving members and/or which require a high driving power, which increases the manufacturing and use costs of such solutions.

FR2946953 describes a boat of the type mentioned above having a rigid structure hinged to the hull of the boat in an area of the hull at the back of the living area; a rigid canopy can slide along this structure adapted to take a first working position above the above area and a second position separate therefrom, and in which the canopy is overlapped on a support structure placed between said area and the stern of the boat. This structure is advantageously mobile relative to the hull at the back of said living area so as to exit from such a hull to receive the canopy when it switches from the first to the second working position and be able to fit into the hull after mating with the canopy bringing the latter to a position close to said hull.

This known solution has the drawbacks mentioned above related to the presence, in a median position, along the hull at the back of the living area, of the structure for moving the canopy. The presence of such a structure in said position prevents a free access to the part of the hull occupied thereby, also because the canopy is always connected thereto. This structure and the support one adapted to receive the canopy greatly limit, with their presence, the use of the boat by the users on board it, which, with closed canopy, are completely blocked in the living area.

This may have, in addition to unpleasant implications for the occupants of that area with canopy closed, both for the complete winding of the hull and canopy of that area and the point of view of safety: in case of need, the persons on board the boat would have difficulty to quickly leave the living area completely closed on all sides and top.

In addition, the solution of FR 2946953 can be validly used for small boats of small size and not for large boats that have large living areas at their aft area.

Therefore, the solution of FR 2946953 has limited functionality for the occupants of the boat, it occupies a significant part of the latter preventing the use thereof by the people on board and, last but not least, it is complicated to manufacture and assemble on board the boat in the light of both the size and the positions of the various mobile portions (moving structure of the canopy and support structure) provided by the known solution.

U.S. 2010/0083890 describes a boat with canopy rotatable relative to the windscreen of a living area of a boat. This solution, however, provides that the canopy is always clearly visible on the hull, always occupies a position or space above it which can also impact on the safety of movement by the occupants of the boat on the deck of the latter.

The object of the present invention is to provide a boat with a mobile rigid canopy which overcomes the drawbacks of the known solutions.

In particular, the object of the invention is to provide a boat of the type mentioned wherein the canopy, both when in the first working position and when in the second working position, arranges itself in an aesthetically pleasant manner compared to the overall "profile" of the boat.

Another object is to provide a boat wherein no particular support structure of the canopy is required when in its first working position, this without imposing structural changes of the boat and allowing the use of the invention also on boats already known with minimal modifications.

A further object is to provide a boat wherein, when the canopy is in the first working position, a further compartment is freed for the passengers of the boat (still known by the term of "dinette") that is covered and closed by such a canopy when it is in its second working position.

These and other objects which will be apparent to the man skilled in the art are achieved by a boat according to the accompanying claims.

For a better understanding of the present invention, the following drawings are attached by way of example, in which.

Figure 1:
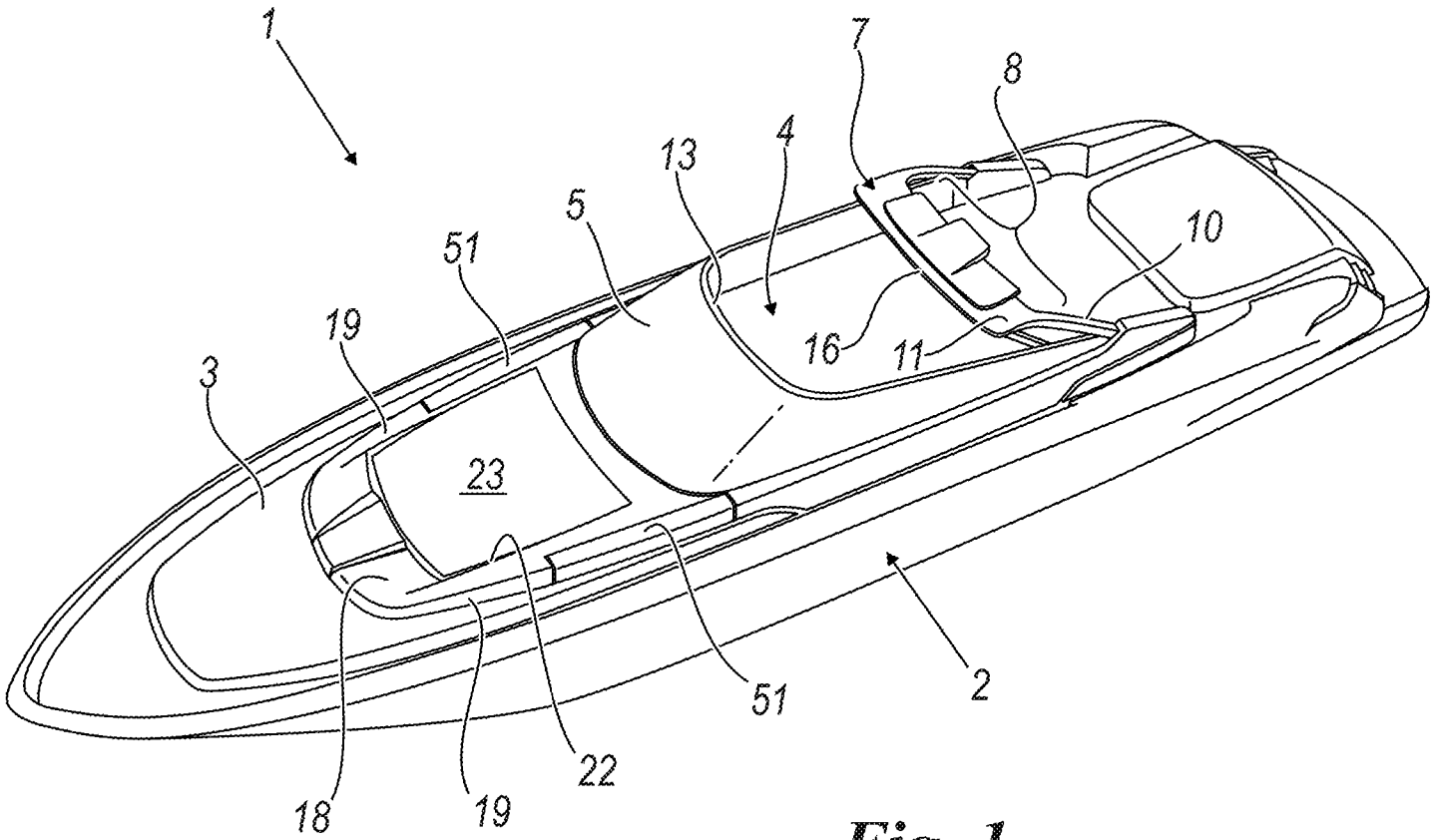
FIG. 1 shows a top view of a boat according to the present invention with mobile rigid canopy in a method of use.

With reference to the above figures, a boat according to the invention is generically indicated with reference numeral 1 and comprises a hull 2, a deck 3 and a living area 4 of deck 3, which includes a control area of the boat (said area simply referred to as "living area 4" is commonly known by the term "cockpit"). Deck 3 is located in front of area 4 and is separated from the latter by a windscreen 5. In the living area 4 there is an elevated fixed structure 7 (commonly known as "radar arch") carrying functional members and devices 8 of the boat such as antennas, radars or the like (which are only shown in FIG. 1). Such a structure has side support arms 10 and a cross member 11 that connects them and supports devices 8, said cross member being located at a distance from an upper edge 13 of windscreen 5 and having a side edge 16 thereof facing the latter.

Figure 2:
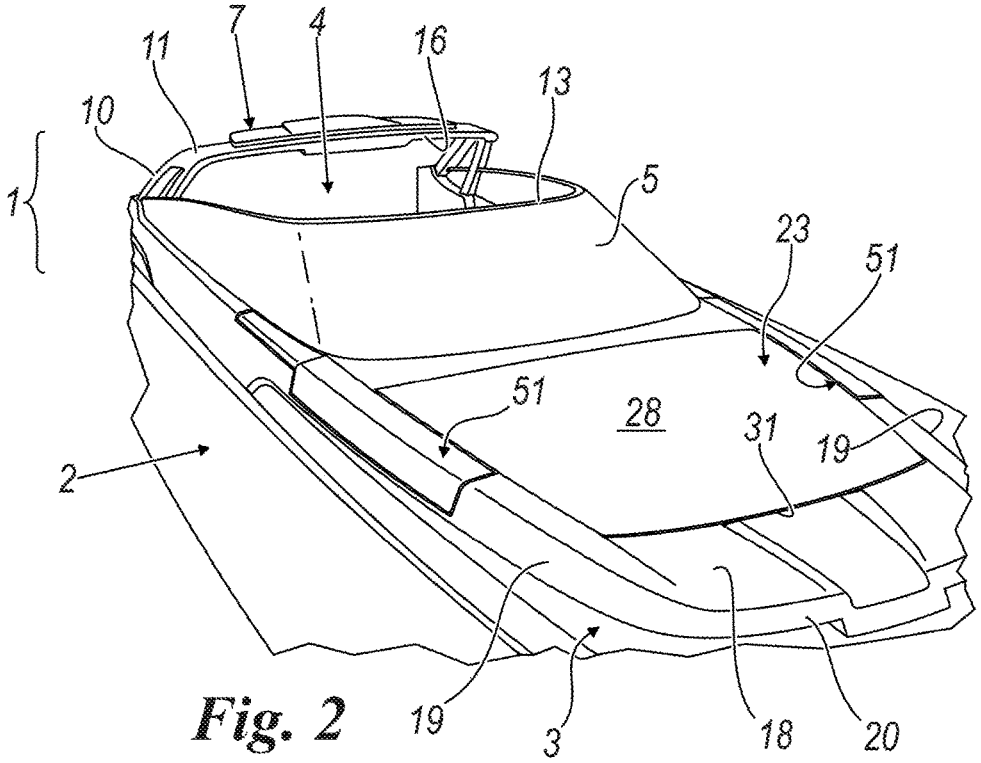
FIG. 2 shows a perspective partial close-up view of the boat in FIG. 1.
Figure 3:
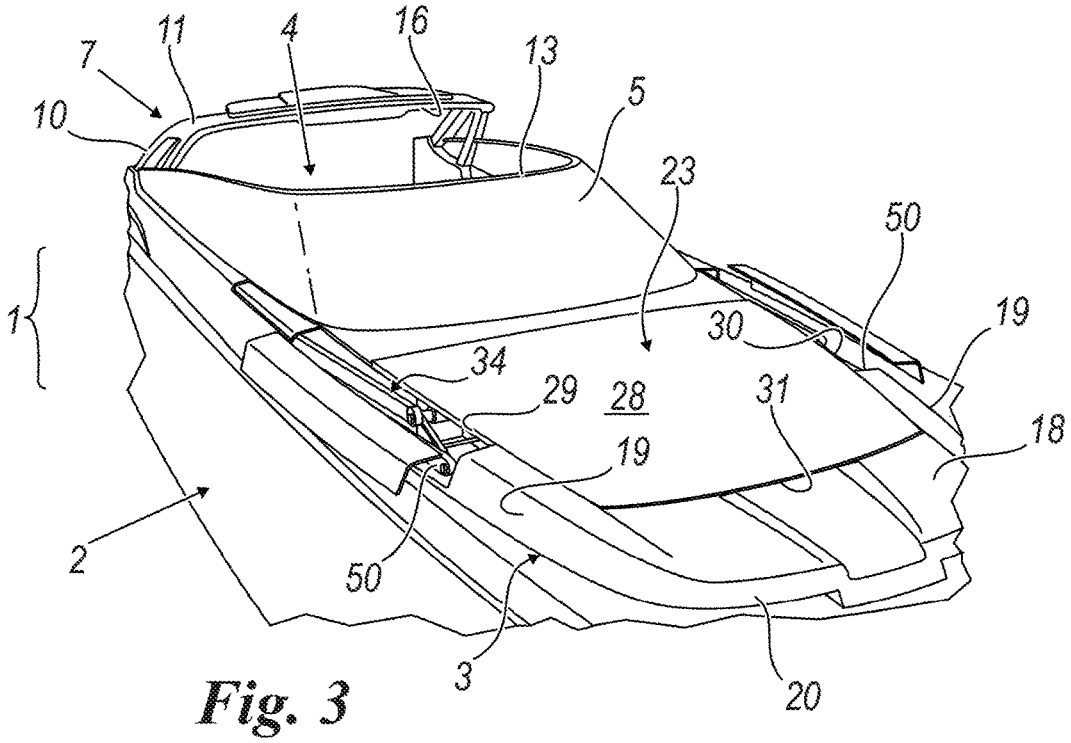
FIGS. 3 to 5 show views similar to that in FIG. 2 showing the various steps of movement of the canopy with which the boat object of the invention is provided.
Figure 4:
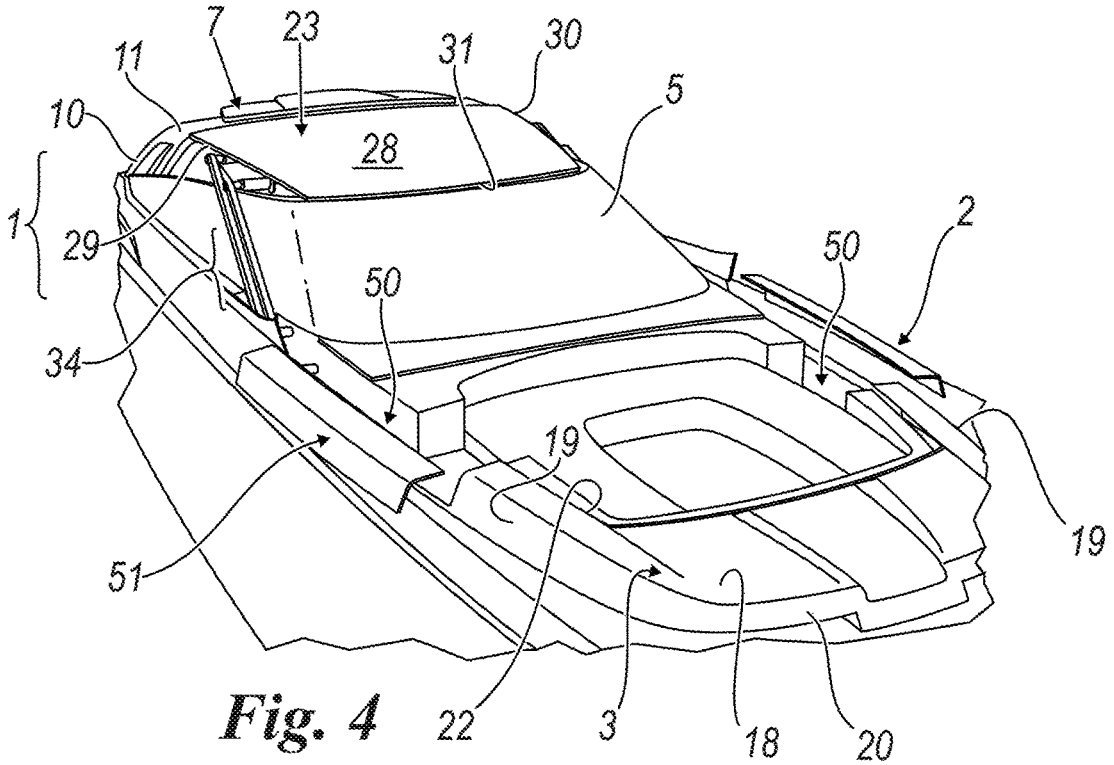
Figure 5:
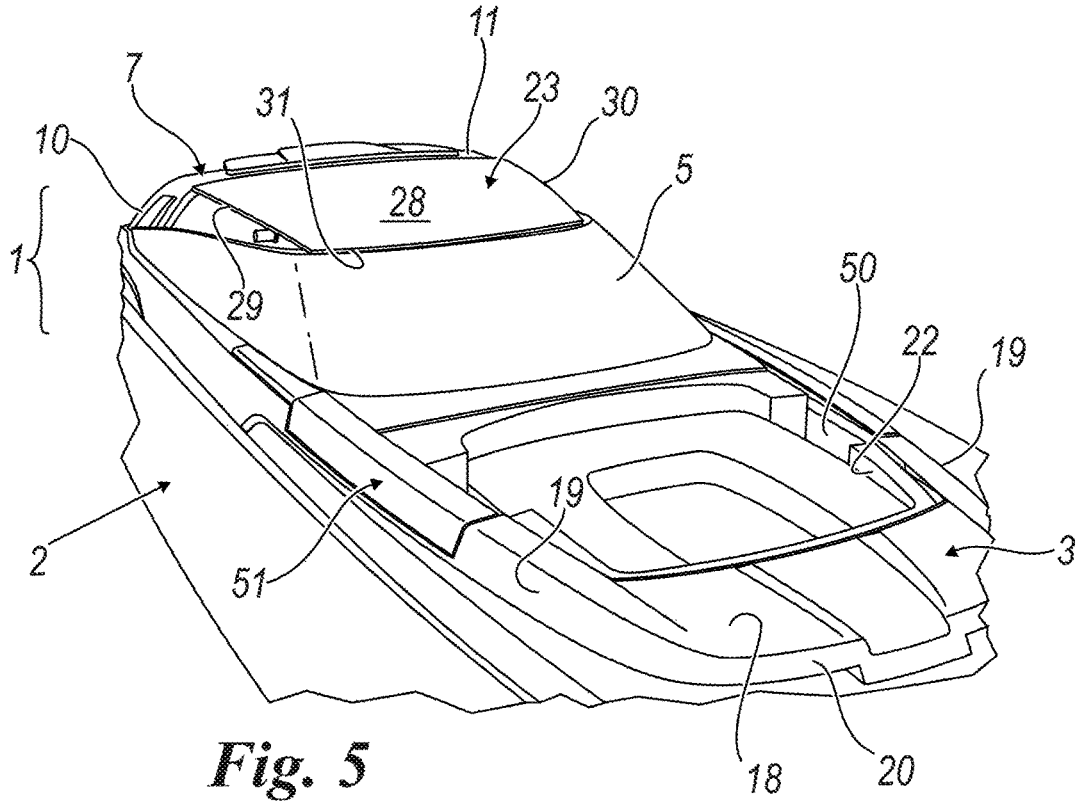
Figure 22:
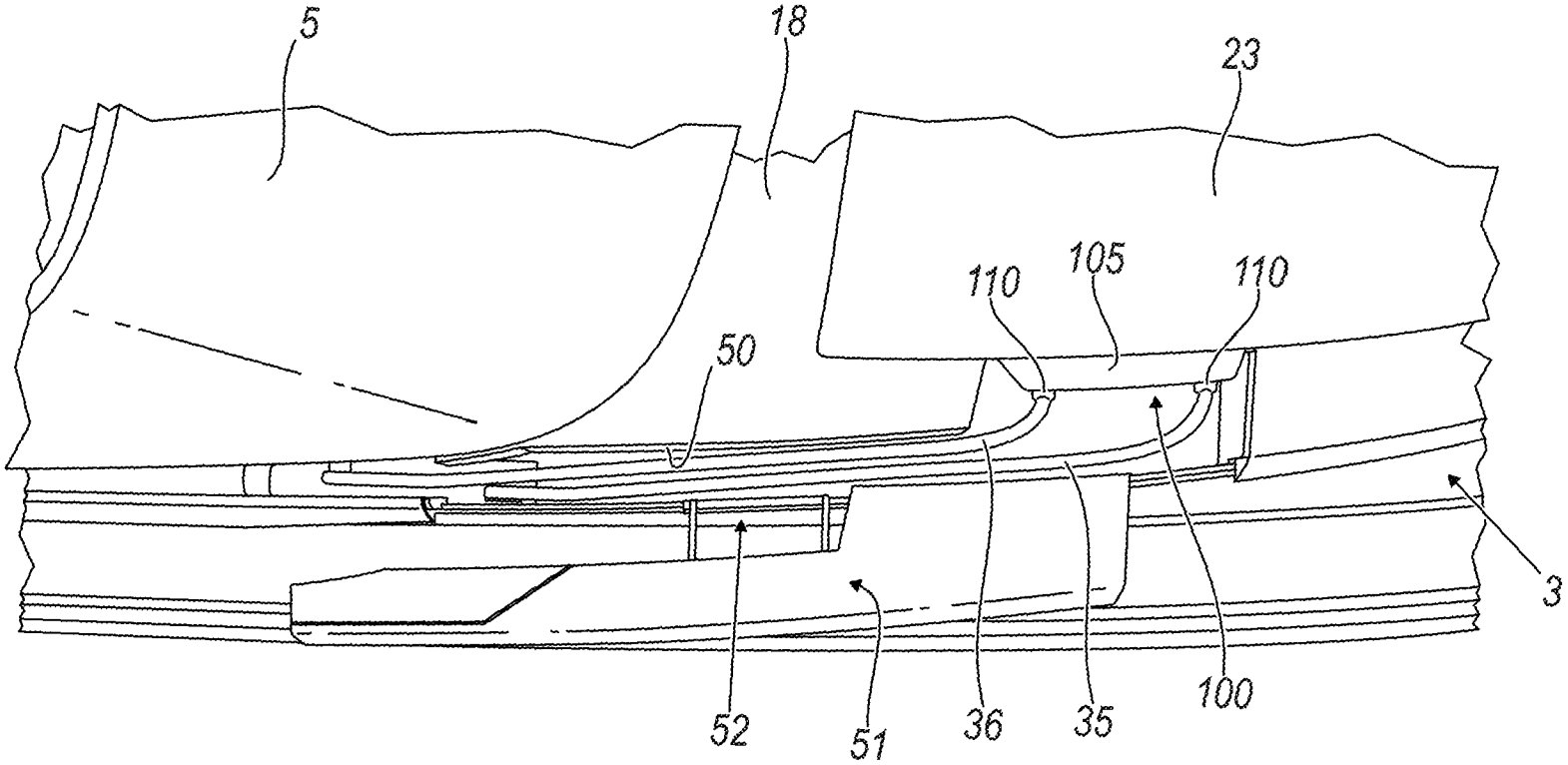
FIG. 22 shows a top view of a detail of the boat in FIG. 15 with the canopy in its second working position.

In the embodiment in the figures, the deck has an upper part or deckhouse 18, opposite side edges 19 and a front edge 20 jointed to the side edges. In deckhouse 18 of the deck there is provided a seat 22 for a one-piece rigid canopy 23 adapted to be brought above the living area 4 in a first working position (FIGS. 4 and 5) and to be arranged in said seat 22 in a second working position (FIGS. 1, 2 and 22). In the latter position it is completely flush with the adjacent surfaces of deckhouse 18, so as to practically be indistinguishable. This is to the advantage of the aesthetics of the boat.

More particularly, the rigid canopy 23 has a body 28, opposite side edges 29, 30, a front edge 31 and a rear edge (with reference to the axis of the boat). The side edges and 30 are associated to corresponding articulated structures 34 defined by pantographs having arms 35, 36 hinged at a first end 35A, 36A thereof, to a corresponding side edge 19 of deck 3 and at second end 35B, 36B thereof to said edges 29 and 30 of canopy 23. Such articulated structures 34 are thus placed at edges 19 of the deck; deckhouse 18 of the latter thus being perfectly free from moving members (the articulated structures 34) whose presence could impede the free movement of people on board the boat. Therefore, also with canopy 23 placed above the living area 4, deckhouse 18 remains an area of deck 3 which is fully liveable, where the above people can stay and/or move freely. Therefore, thanks to the invention, the moving members do not limit, with their presence, the possibility of using the deck in any part thereof, even when canopy 23 is in its first working position.

Advantageously, moreover, for the reasons which will be described hereafter, such second ends 35B, 36B are separable from edges 29, 30 of canopy 23.

It should be noted that canopy 23 is to be considered one-piece even if it includes mobile wings (hinged or sliding with respect to the side edges 29, 30 so as to be extended therefrom or retracted therein). The word "one-piece" indicates that body 28 of canopy 23 has such dimensions as to cover the entire seat 22.

Figure 10:
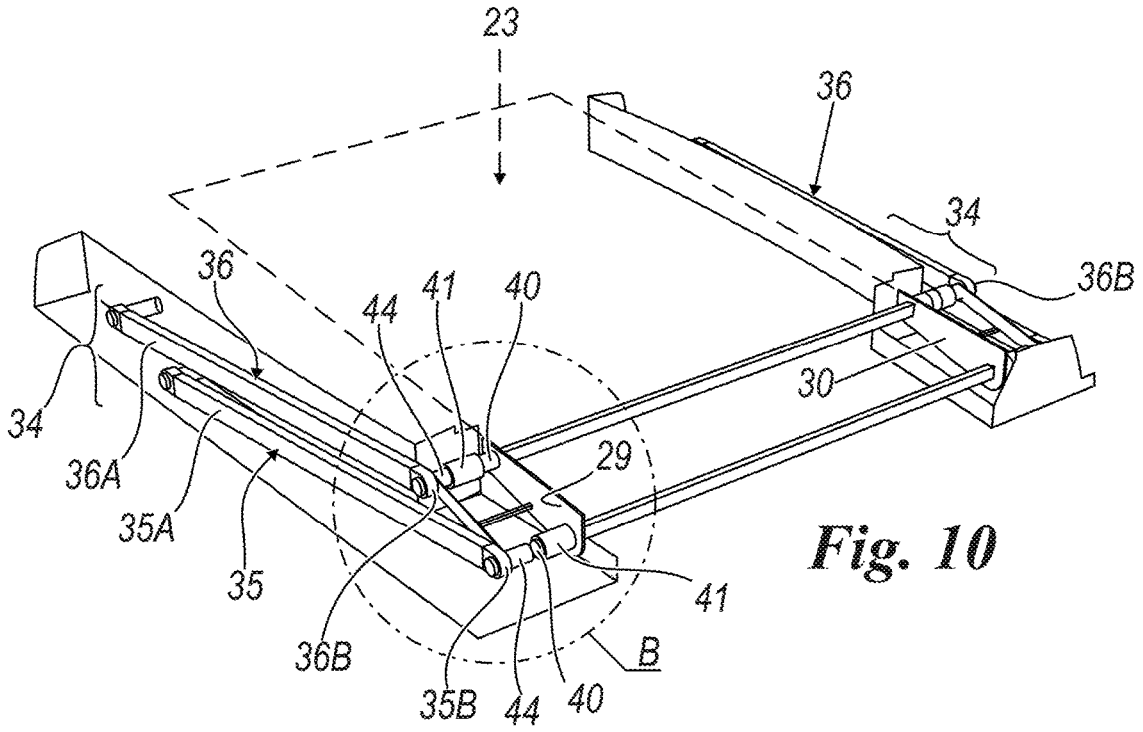
FIG. 10 shows a perspective view of a part of the boat according to the invention.
Figure 11:
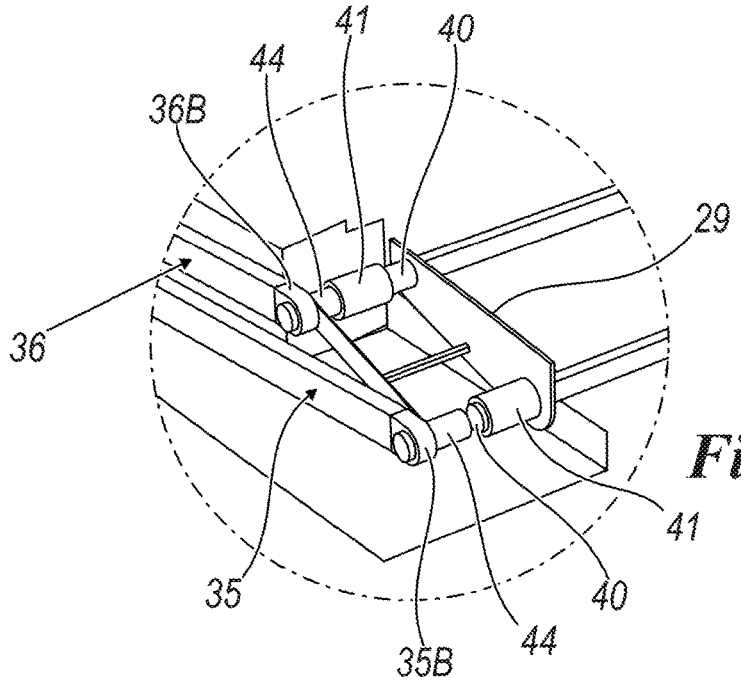
FIG. 11 shows an enlarged view of a part indicated with B in FIG. 10.

With reference to FIGS. 10 and 11, the edges of canopy 23 (shown schematically with plates in these figures), in order to obtain the separation between the canopy itself and arms 35 and 36, in a first embodiment, body 28 mentioned above supports pins 40 on which mobile sleeves 41 are arranged, said pins being protruding from edges 29 and 30. Sleeves 41 may protrude from such pins 40 so as to overlap pins 44 carried by the second ends 35B, 36B of arms 35, 36 of each corresponding pantograph or structure 34. In such an overlapping position, each pantograph is connected to canopy 23 and can move the latter.

If, however, sleeves 41 are supported on pins 40 only, the pantographs are separated from canopy 23 and can be moved independently. In this way, only canopy 23 can be kept in the first working position with great advantage from the aesthetic point of view of the boat.

Sleeves 41 may move on the corresponding pins 40 (or, in a specular manner, on pins 44) by simple sliding (preferably driven) in spring contrast or by screwing; alternatively, according to any known methods, sleeves 41 may be subject to magnetically activated elements, be driven by electric stepper motors or by hydraulic actuators. Any such actuators or (non-manual) means for moving the sleeves may be associated to articulated structures or pantographs 34, or preferably to the canopy. Of course, the releasable link between the canopy and arms 35, 36 can be obtained in another way: for example, by providing mobile retaining pins associated to one of the canopy and each articulated structure 34, said pins cooperating with seats provided in the other of said canopy and said articulated structures 34. The pins may be moved by mechanical actuator, electric or hydraulic and/or pneumatic motor.

In the variant in FIGS. 15-22, canopy 23 includes a central support "beam" 100 protruding from the opposite side arms 29, 30 of body 28 of the canopy with ends 101 thereof. A hinged door (openable manually or automatically in a per se known manner) 105 is arranged on each of them. Each end 101 has seats 107 for the second ends 35B and 36B of arms 35 and 36 which, in the embodiment under consideration are shaped as a substantially spherical body. Seats 107 have a shape complementary to said ends 35B and 36B.

At the latter, on each arm 35 and 36 there is a collar 110 adapted to position in abutment on the outside of the corresponding end 101 of beam 100 when said ends 35B and 36B of the arms are inserted in seats 107. Closing door 105, there occurs the constraint between the arms and the canopy, a constraint that is removable when the canopy is in the first working position (see FIG. 19), position in which the spherical ends 35B and 36B of the arms can be removed from seats 107 keeping the canopy fixed and moving the arms (see FIG. 19).

Figures 12, 13, 14:
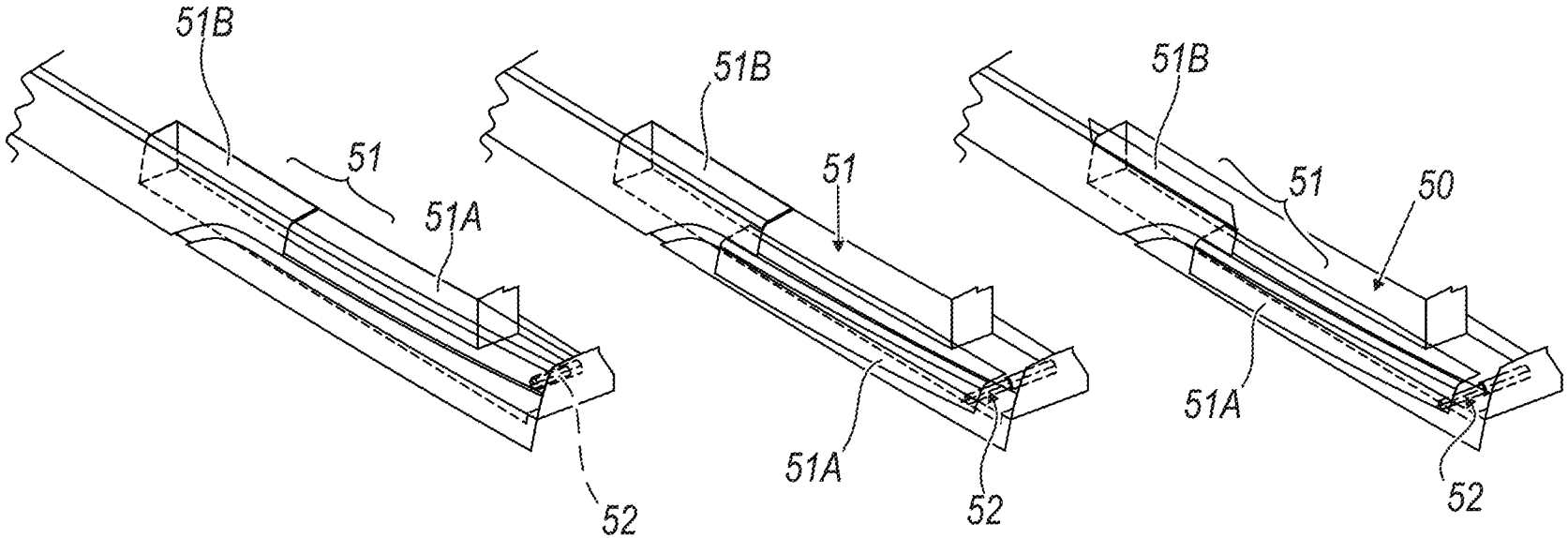
FIGS. 12, 13 and 14 show three details of the boat according to the invention in three different steps corresponding to different positions of the mobile rigid canopy.

The above structures or pantographs 34, when the canopy is within seat 22, are arranged along the side edges 19 of deckhouse 18 of deck 3. Preferably, arms 35, 36 of each structure above are suitable for seating in seats 50 provided along said edges 19 and closed by mobile cover elements 51 thereof. Each of the latter is preferably associated to an actuator 52 (such as a hydraulic piston, see FIGS. 12-14), which allows the opening or closing movement thereof on the respective seat 50, in a completely automated manner. Of course, these elements can be moved with other electric or mechanical actuators or directly in manual mode.

Preferably, each element 51 has two adjacent and consecutive cover components, one (indicated with 51A in FIGS. 12-14 and 15-16) moved by actuator 52 and another one (indicated with 51B) mobile on the thrust of the corresponding pantograph or structure 34 when this moves to move the canopy from the second working position to the first one. Component 51B of each mobile cover element is simply hinged to side 19 of the corresponding deck and is close to the first end 35A, 36A of the corresponding structure or pantograph 34.

According to a further embodiment, each element 51 is one-piece and moves parallel to itself subject to an actuator 52 (see FIGS. 19-22).

Thanks to the presence of seats 50 closable by their own closing members 51, an optimal aesthetic effect of the boat according to the invention is obtained. In fact, when canopy 23 is in its second working position, deck 3 is completely free from elements (moving members or structures 34) the presence of which would affect the "smoothness" or continuity of the surface of such a deck. In addition, in the case of separation of the canopy from said structure 34, the latter return to their seats 50 which are closed by their own cover elements 51; such structures 34 (contained "retractable-wise" or completely in seats 50) are no longer visible, thus contributing to not affecting the aesthetic appearance of the deck with their presence.

Figure 15:
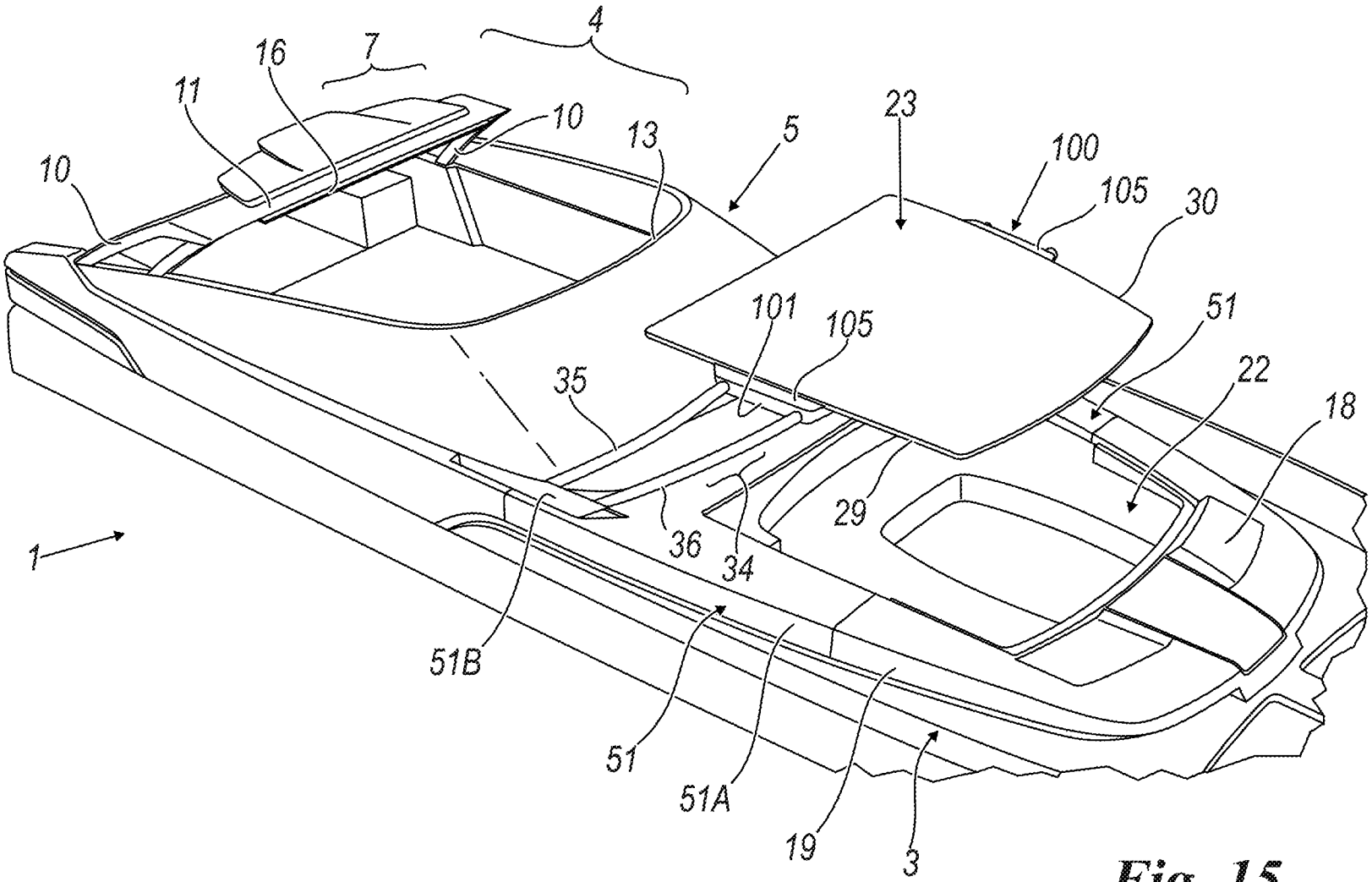
FIG. 15 shows a partial perspective view of a boat according to a further embodiment of the invention, with the canopy in a different working position.
Figure 16:
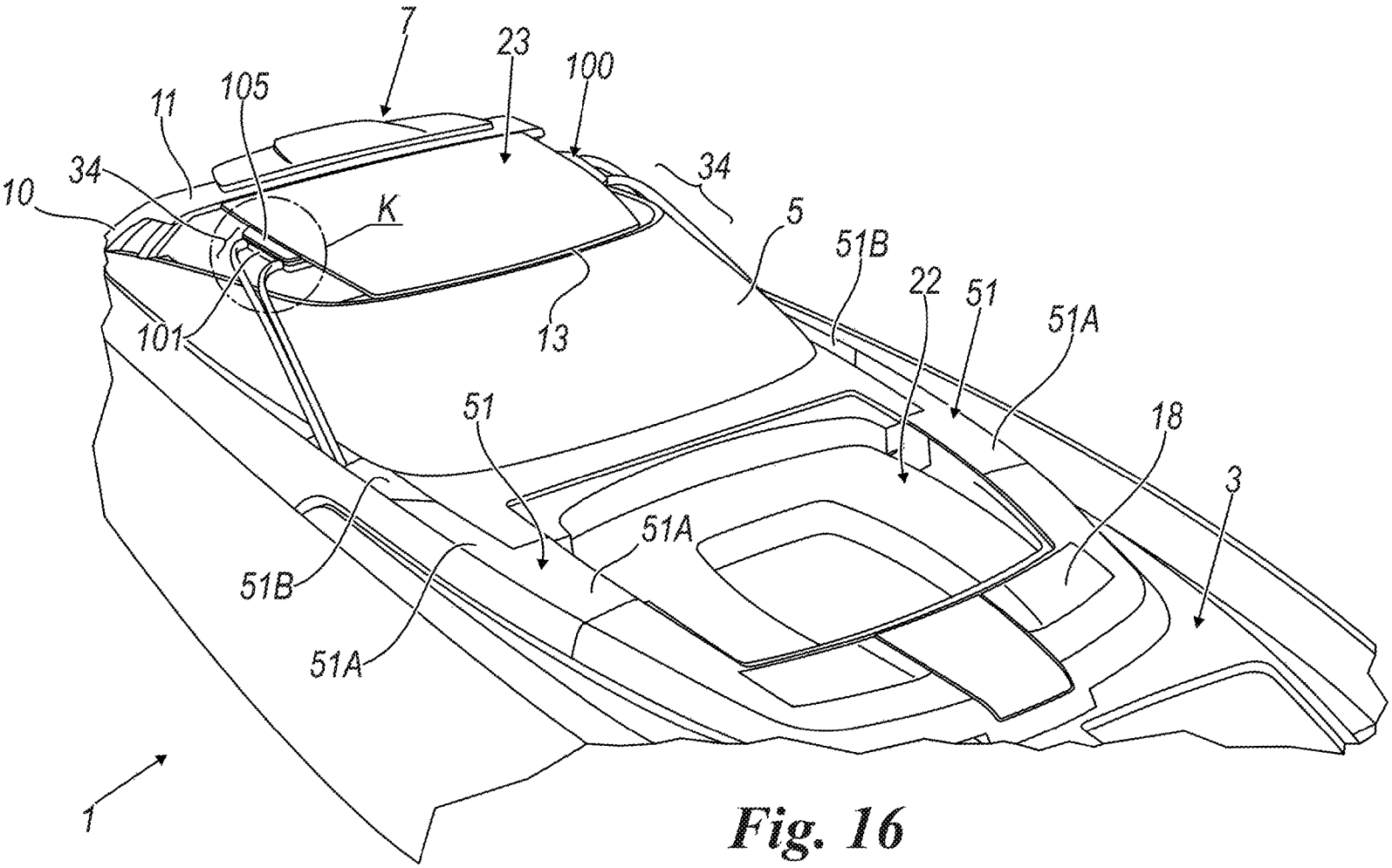
FIG. 16 shows a view similar to that in FIG. 15, but with the canopy in the first working position.
Figure 17:
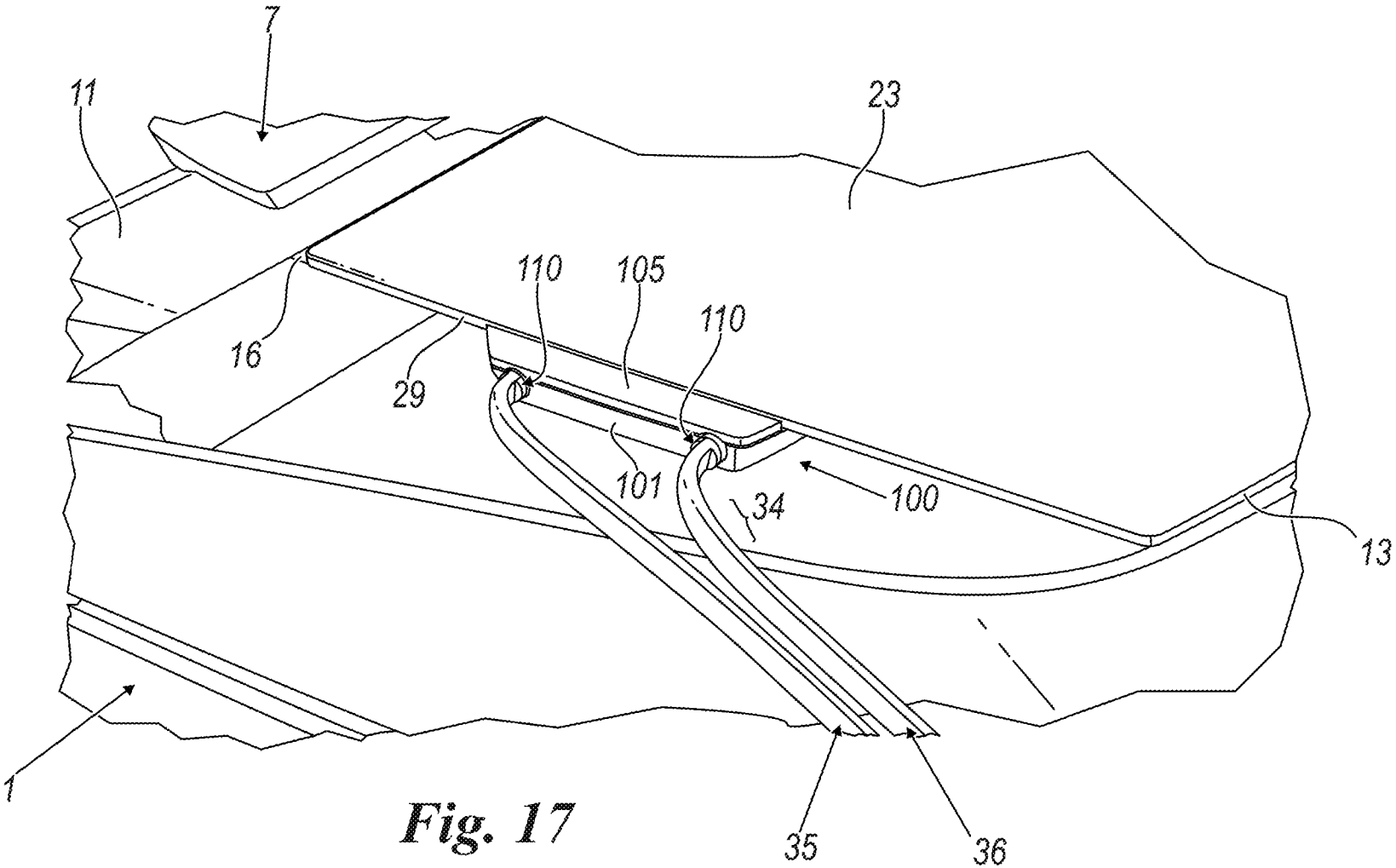
FIG. 17 shows an enlarged view of the detail indicated with K in FIG. 16.
Figure 18:
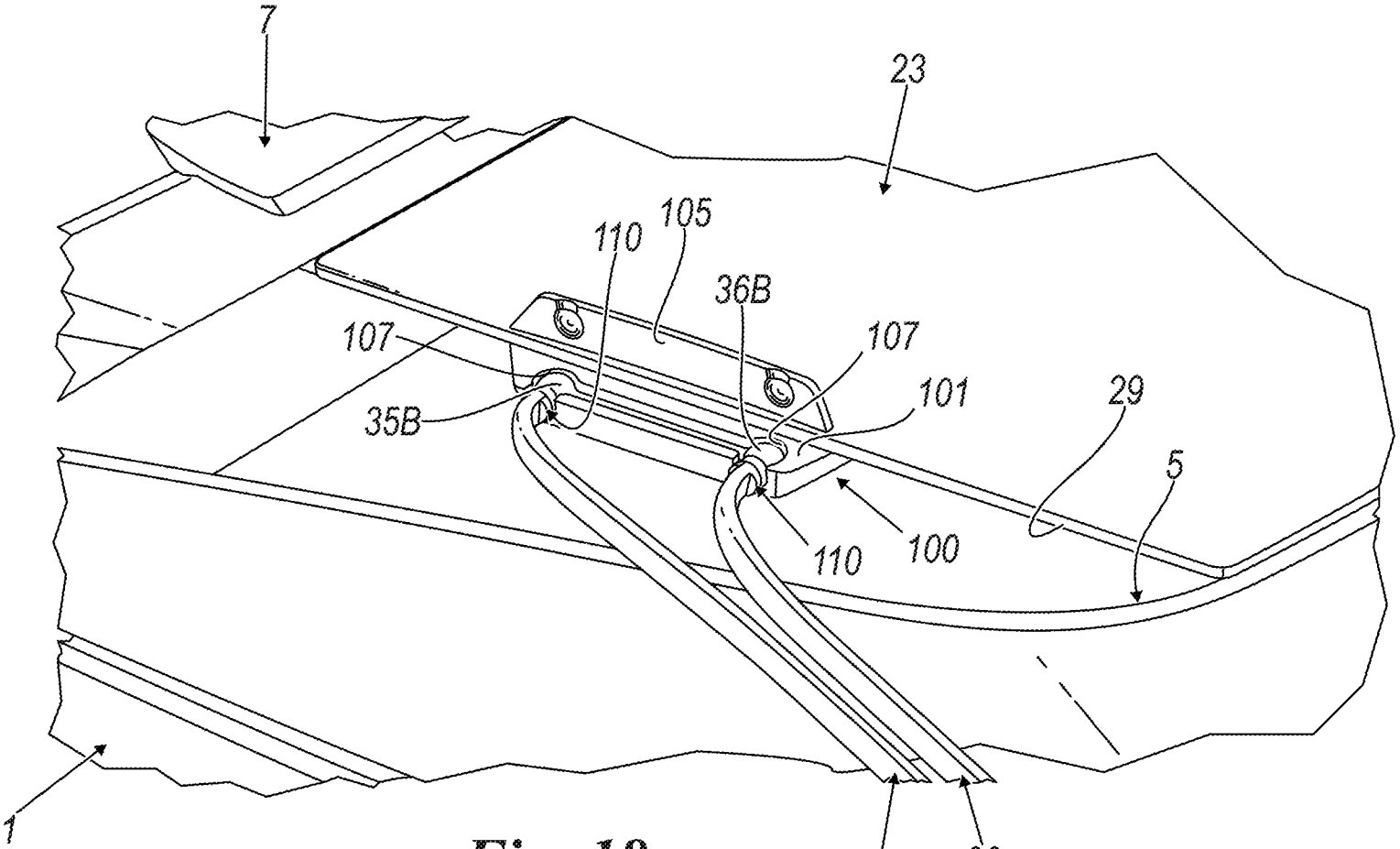
FIG. 18 shows the detail of FIG. 17 but in a different usage step.

Each structure or pantograph 34 is mobile in order to allow canopy 23 to switch from a working position to another one moving parallel to itself, but also to take intermediate positions between the first and the second in order, for example, to shade the living area 4 or an equipped rest area commonly referred to as "dinette" (such as with chairs and sofas) made within seat 22 of the canopy and usable when the latter is extracted therefrom. FIG. 15 shows a (third) working position wherein the canopy generates a shadow over area 22.

In order to move the actuators, pantographs 55 are provided which may be defined by stepper motor groups, worm screw and rack, stepper motor and toothed gears, hydraulic or pneumatic members or the like. Such actuators are connected to the corresponding articulated structures in any known manner and therefore such a connection will not be described. It should be noted that each actuator can in turn be connected to a moving member (not shown) located in the corresponding seat 50 of deck 3 in order to move it in the latter so as to obtain a corresponding movement of canopy 23 (e.g. to better position it above the rest area formed in seat 22) and a simpler positioning thereof in the first or second working position.

As mentioned, canopy 23, moved by the articulated structures 34, can be positioned above the living area 4. According to the invention, such a positioning takes place without providing any dedicated support structure at that area but engaging elements and parts already present therein, namely windscreen 5 and structure 7. This helps preventing the presence in this area of members that could affect the aesthetics of the boat.

Figures 6, 7, 8:
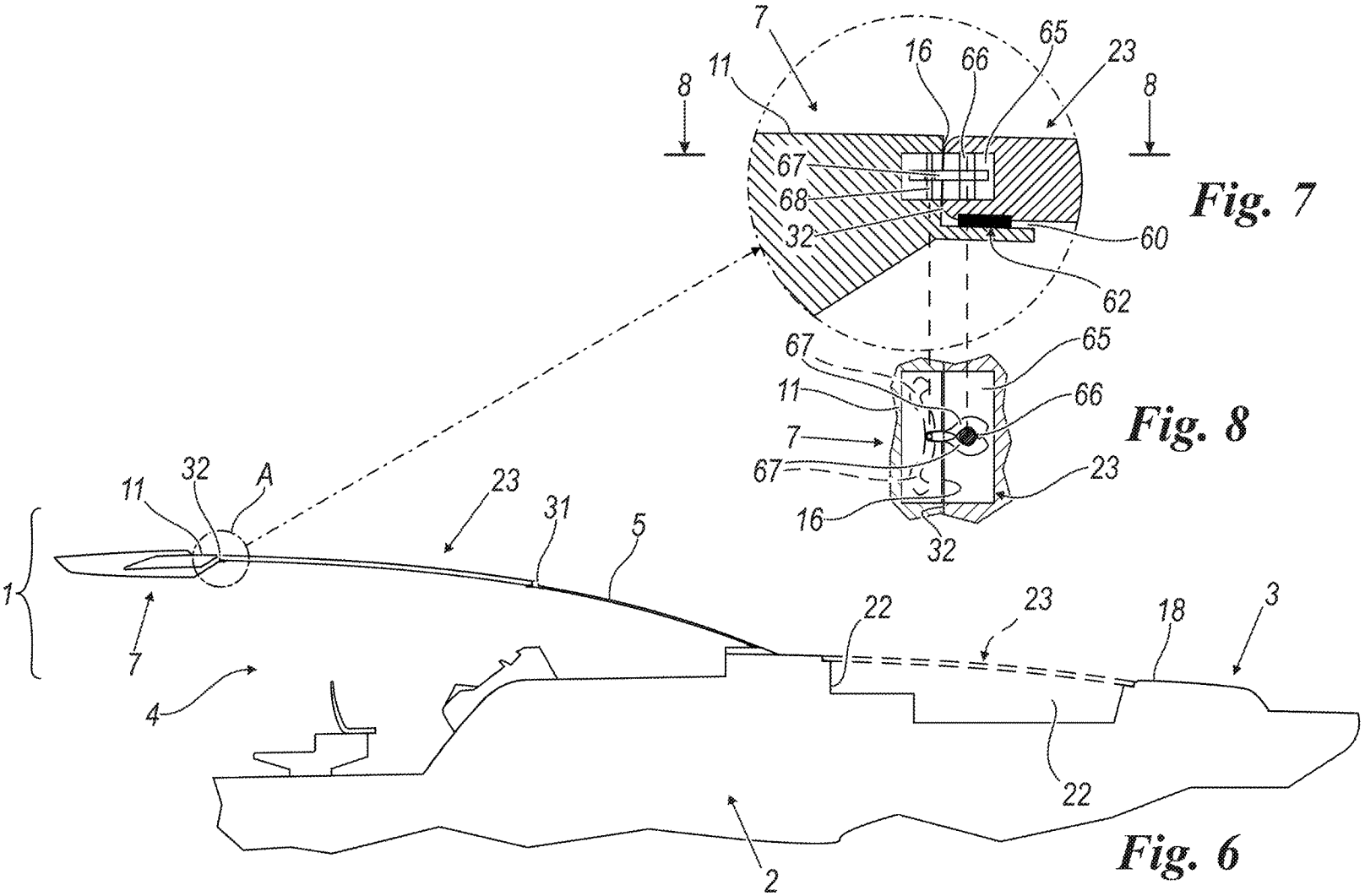
FIG. 6 shows a side, schematic and partial view of the boat in FIG. 1 with the canopy in a first working position represented with a full line and in a second working position represented with a dashed line.
FIG. 7 shows an enlarged view of the part indicated with A in FIG. 6 and shown in cross section.
FIG. 8 shows a section according to line 8-8 in FIG. 7.
Figure 9:
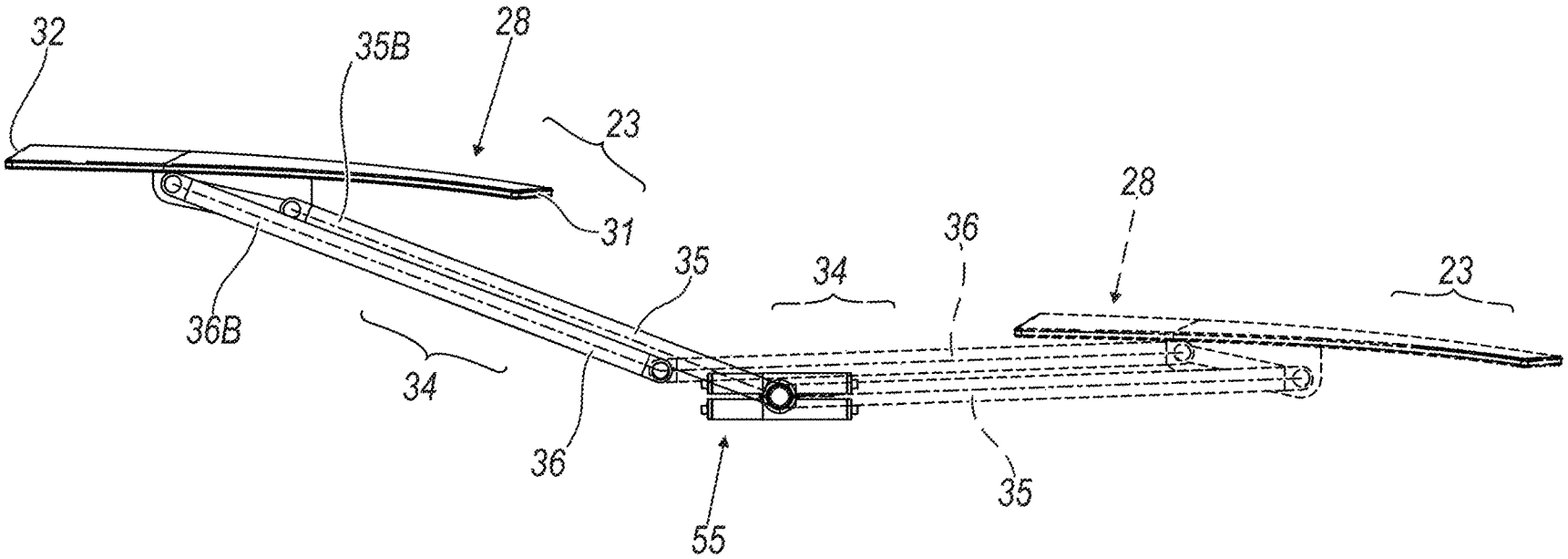
FIG. 9 shows a schematic view of the canopy of the boat and of the movement members associated thereto in different working positions, the first being with a full line and the second position being with a dashed line.

More particularly, according to the invention, canopy 23 rests on edge 13 of the windscreen with its front edge 31 and on edge 16 of structure 7 with its rear edge 32. To this end, preferably, edges 13 and 16 have a recess 60 (see FIG. 7) on which the relative edge 31 or 32 of the canopy may rest. Advantageously, at least one of the contact surfaces (13, 16, 31, 32) supports a sealing element 62.

Furthermore, edge 16 is preferably made as an adjustable support bar for the canopy to compensate for any movement or misalignment between the canopy and the parts adapted to be brought into relative contact thereto over time. Such a bar is provided with adjustment members, for example screw, which allow a movement of a first horizontal (towards windscreen 5) or pivoting about a median axis of the bar itself. In this way, any tolerances of construction or that occur over time can be compensated to keep the canopy in contact with windscreen 5 and bar 16.

Canopy 23 is fixed to the relative support (windscreen or structure 7) by means of one or more retaining elements that may include manually driven members, automated motor members, magnetisable or hydraulically and/or pneumatically mobile members. In one embodiment (FIGS. 7 and 8) there is provided a plurality of recesses 65 within the canopy wherein there are pins 66 adapted to cooperate with mobile arms 67 associated to structure 7 or to windscreen 5, rotating about a pin 68 and lockable on the corresponding one 66, which may be actuated manually.

Figure 19:
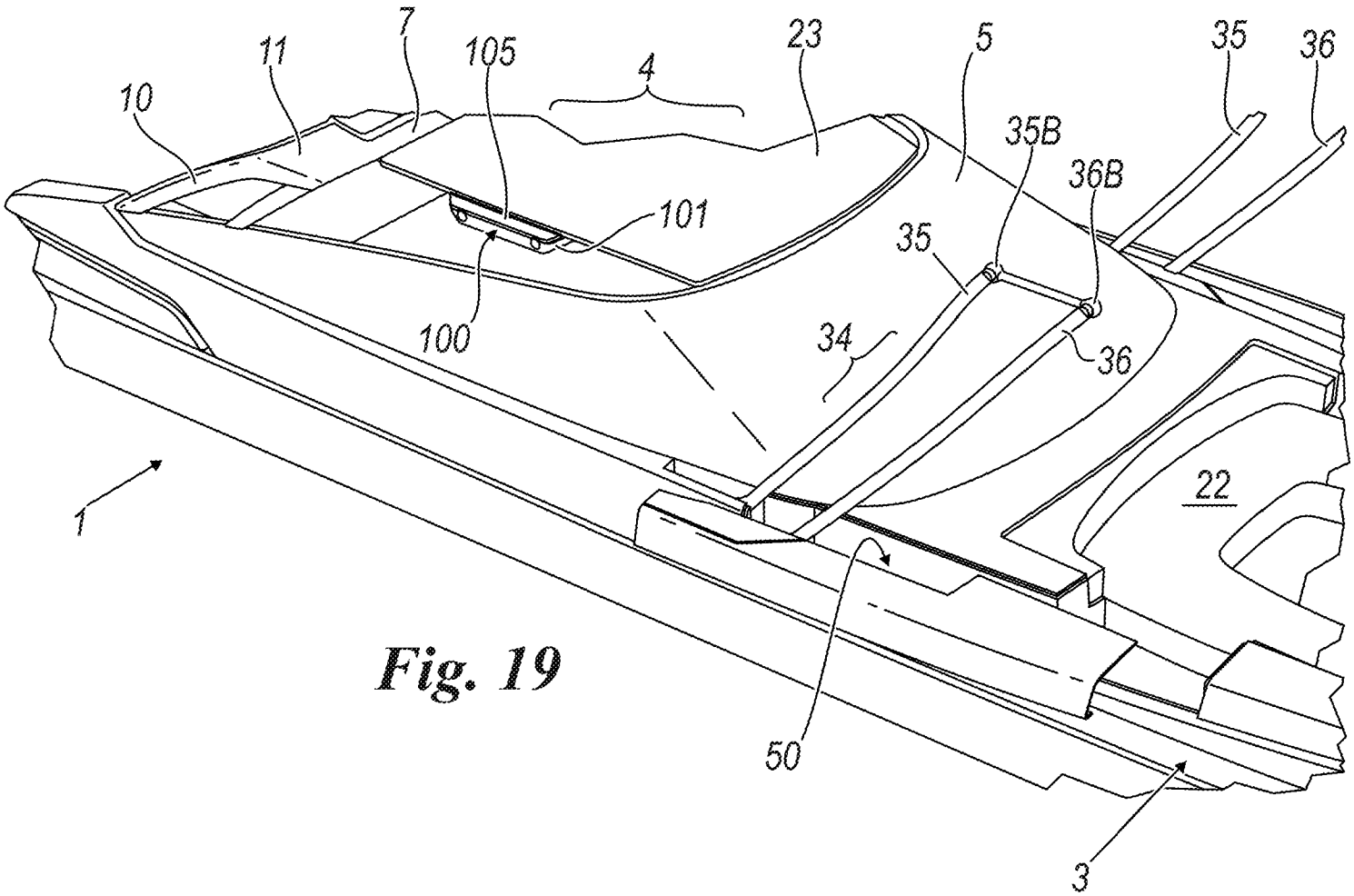
FIG. 19 shows a perspective view of the boat in FIG. 15, but in a different usage step.
Figure 20:
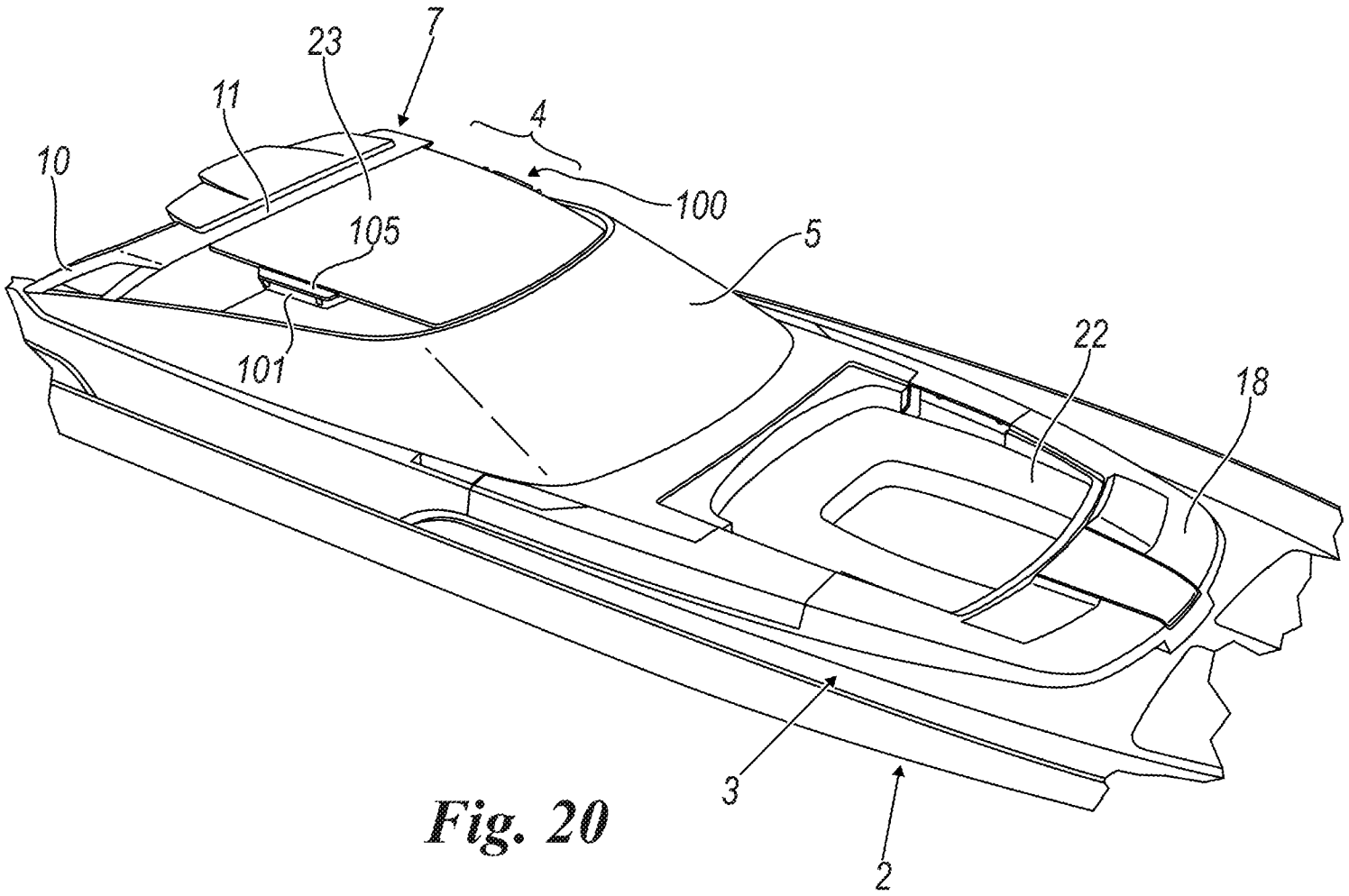
FIG. 20 shows a view similar to that in FIG. 16, but with the canopy autonomously released in its first working position.
Figure 21:
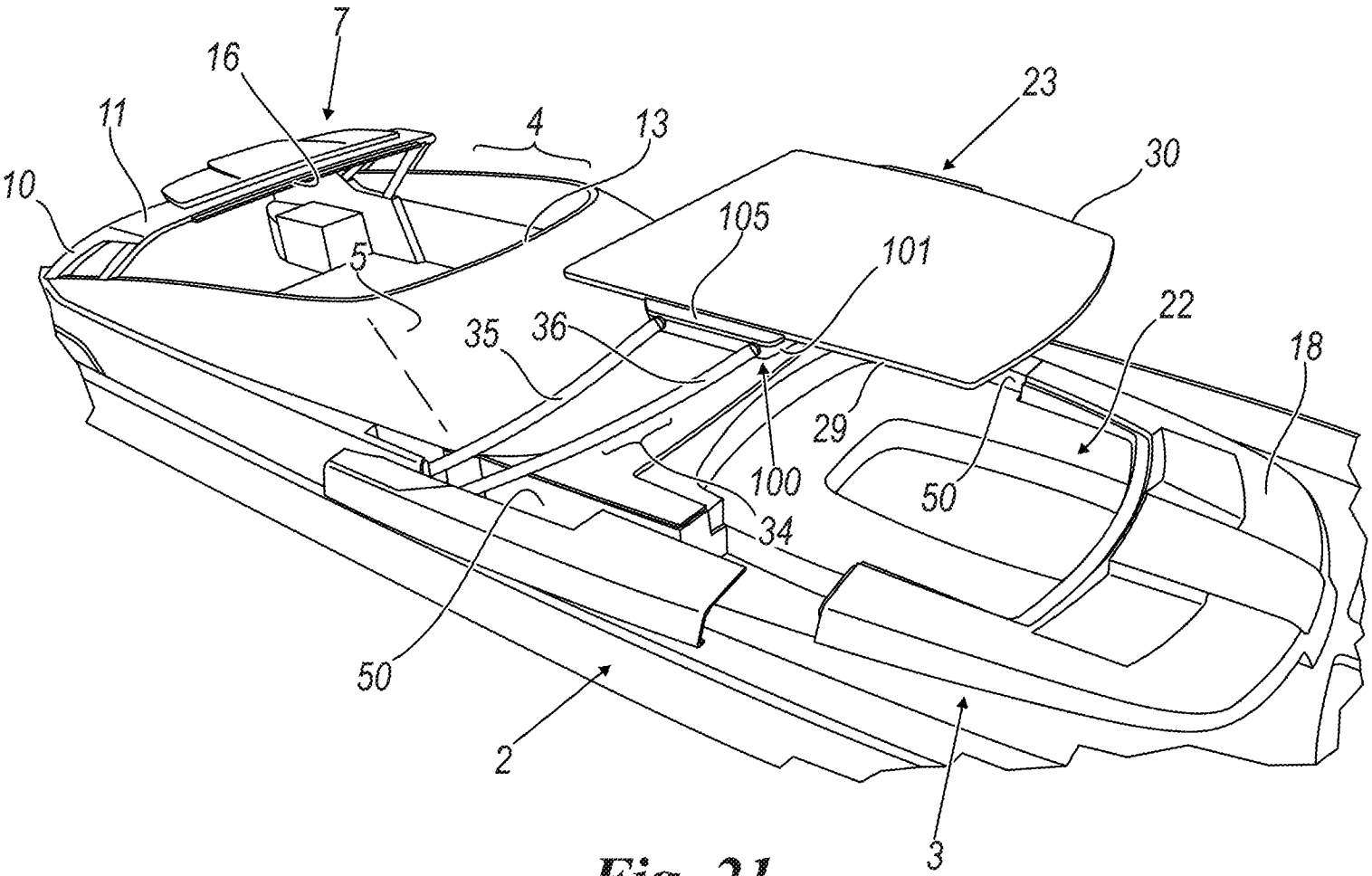
FIG. 21 shows a view similar to that in FIG. 15, but in a different embodiment of the invention.

Once canopy 23 has been locked in the first working position, the articulated structures 34 can be separated therefrom (by moving, in the embodiment described, sleeves 41) and be placed in seats 50 of deck 3 (which are then closed by elements 51 as shown for example in FIG. 19 during their return movement in the respective seat 50). The resulting boat with has a "clean" shape not aesthetically interrupted by the above structures 34.

The boat according to the invention is thus provided with a one-piece rigid canopy easy to move, the presence whereof in the first and second working position affects neither the aesthetics of the boat itself nor its aerodynamics. Moreover, the boat according to the invention does not require any changes in the living area 4 that may negatively affect its aesthetic appeal and the functionality of the boat.

A particular embodiment of the invention and yet others have been described. Of course, a man skilled in the art may find other methods of implementation of the above invention in the light of the above description (such as one that provides lighting members such as bulbs associated to a face of the canopy facing deck 3 and the living area 4), methods which are in any case to be considered as falling within the scope of the following claims.

The invention claimed is:

1. A boat comprising a hull, a deck, a living area, and a one-piece mobile rigid canopy, the living area delimited at a front end thereof by a windscreen and having a fixed structure extending upwardly from the living area and supporting at least one functional member of the boat, the one-piece mobile rigid canopy configured to be moved by moving members integral to the deck, the canopy being adapted to move between at least a first working position in which the canopy is arranged above the living area and at least a second working position in which the canopy is separated from the living area and is associated to and positioned in contact with the deck at a location in front of the windscreen, the rigid canopy resting on and being constrained to the windscreen and to the fixed structure when the canopy is in its first working position, wherein the moving members are articulated structures which laterally support the canopy, the articulated structures each arranged at respective side edges of the deck to free up an upper part or deckhouse of the deck when the canopy is in its first working position, allowing free use of the upper part or deckhouse by people on board the boat, and wherein the deck comprises deck seats for seating the articulated structures, the deck seats arranged along opposite lateral edges of the deck, the deck seats having deck seat mobile cover elements adapted to close and contain the respective articulated structures, the articulated structures being retractable articulated structures and the deck seats on each side of said deck containing the respective retractable articulated structures at least when the canopy is in its second working position.

2. The boat according to claim 1, wherein each articulated structure is separable from the canopy when the canopy is in the first working position.

3. The boat according to claim 2, wherein each articulated structure is made as a pantograph structure having arms hinged at a first end thereof to the side edges of the deck and at a second end thereof to the canopy, at said second end there being provided removable connection members for allowing the separation of each articulated structure from the canopy.

4. The boat according to claim 3, wherein said removable connection members are either:

sleeve elements movable along pins of the canopy and the corresponding arms of each articulated structure;

pins movable under the action of mechanical actuators, under the action of an electric or hydraulic and/or pneumatic motor, said pins being associated to one of said canopy and said articulated structures and cooperating with seats or holes provided in the other of said canopy and said articulated structures;

spherical ends of the arms adapted to removably cooperate with said seats associated with the canopy.

5. The boat according to claim 4, wherein the canopy is supported by a beam having beam ends projecting laterally from opposite side edges of said canopy, the beam ends having the seats for the spherical ends of the arms of each articulated structure, on said projecting ends of said beam there being a door for closing said seats for the spherical ends of said arms.

6. The boat according to claim 1, wherein each articulated structure is axially mobile along the hull.

7. The boat according to claim 1, wherein the canopy in its first working position is fixed to the windscreen and to the fixed structure.

8. The boat according to claim 7, wherein lockable retaining means are provided associated to one of said canopy and said windscreen and fixed structure adapted to cooperate with counter-means associated to the other of said canopy and said windscreen and fixed structure, said cooperation enabling the attachment and the separation of the canopy to/from the windscreen or fixed structure.

9. The boat according to claim 8, wherein said retaining means are alternately manually or automatically activated members.

10. The boat according to claim 1, wherein the deck has a canopy seat, and wherein the mobile canopy is adapted to be arranged when the canopy is in its second working position.

11. The boat according to claim 1, wherein at least one of said canopy and said windscreen and the fixed structure comprises sealing elements.

12. The boat according to claim 1, wherein said fixed structure comprises a support bar for the canopy, the position of the support bar on said fixed structure being adjustable in a horizontal plane and/or about a median axis of the support bar itself to allow the compensation of any construction tolerances or movements that occur over time for keeping the canopy always in contact with the windscreen and said bar.

13. The boat according to claim 1, wherein the canopy is always parallel to itself by moving from one working position to another, said canopy being advantageously able to take a plurality of working positions between said first working position and said second working position.

14. The boat according to claim 1, wherein the canopy comprises lighting members associated to a face thereof always facing towards the deck and the living area.

15. The boat according to claim 1, wherein the deck has a canopy seat having an equipped rest area, the canopy being arranged flush with the remaining parts of the deck when it is in the at least second working position.

16. The boat according to claim 1, wherein the deck has a canopy seat having an equipped rest area, wherein the canopy is always parallel to itself by moving from one working position to another, the canopy being advantageously able to take a plurality of working positions between the first working position and the second working position positioning itself above the rest area provided in the canopy seat of the canopy itself.

* * * * *